US007299880B2

(12) United States Patent
Logiudice et al.

(10) Patent No.: US 7,299,880 B2
(45) Date of Patent: Nov. 27, 2007

(54) SURGE REDUCTION BYPASS VALVE

(75) Inventors: Michael Logiudice, Spring, TX (US); James G. Martens, Spring, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 179 days.

(21) Appl. No.: 11/167,487

(22) Filed: Jun. 27, 2005

(65) Prior Publication Data

US 2006/0011354 A1 Jan. 19, 2006

Related U.S. Application Data

(60) Provisional application No. 60/588,463, filed on Jul. 16, 2004.

(51) Int. Cl.
*E21B 34/12* (2006.01)
*E21B 43/10* (2006.01)

(52) U.S. Cl. ..... 166/381; 166/373; 166/334.4; 166/332.8

(58) Field of Classification Search ..... 166/373, 166/381, 321, 325, 332.8, 334.4
See application file for complete search history.

(56) References Cited

U.S. PATENT DOCUMENTS 3,457,994 A 7/1969 Stachowiak
3,461,962 A * 8/1969 Harrington ..... 166/330
3,695,293 A * 10/1972 Zeuner ..... 137/625.48
3,997,009 A * 12/1976 Fox ..... 175/107
4,113,012 A 9/1978 Evans et al.
4,324,293 A 4/1982 Hushbeck
4,403,659 A 9/1983 Upchurch
4,415,036 A 11/1983 Carmody et al.
4,452,313 A 6/1984 McMahan
4,531,587 A 7/1985 Fineberg
5,443,129 A 8/1995 Bailey et al.
5,465,787 A 11/1995 Roth
5,609,178 A 3/1997 Hennig et al.
5,743,331 A 4/1998 Adkins et al.
5,960,881 A 10/1999 Allamon et al.
6,082,459 A 7/2000 Rogers et al.
6,102,126 A 8/2000 Huber et al.
6,173,795 B1 1/2001 McGarian et al.
6,263,969 B1 7/2001 Stoesz et al.
6,386,289 B1 5/2002 Patel
6,520,257 B2 2/2003 Allamon et al.
6,543,532 B2 4/2003 Estep et al.

(Continued)

FOREIGN PATENT DOCUMENTS

WO WO 02/088514 A1 11/2002

OTHER PUBLICATIONS

GB Search Report dated Aug. 11, 2005.

*Primary Examiner*—David Bagnell
*Assistant Examiner*—Shane Bomar
(74) *Attorney, Agent, or Firm*—Patterson & Sheridan, LLP

(57) ABSTRACT

Methods and apparatus are provided for reducing surge pressure while running casing into a wellbore. The apparatus includes a running string for running casing having a diverter tool therein. The diverter tool has one or more bypass ports between its upper and lower end which are normally closed. In operation, the diverter tool is automatically cycled between the open and closed positions of the bypass ports during a casing running operation. A pressure event inside the diverter tool deactivates the cyclic opening and closing function of the bypass port.

32 Claims, 6 Drawing Sheets

U.S. PATENT DOCUMENTS

| | | | | |
|---|---|---|---|---|
| 6,571,876 | B2 * | 6/2003 | Szarka | 166/325 |
| 6,820,697 | B1 * | 11/2004 | Churchill | 166/374 |
| 7,108,071 | B2 * | 9/2006 | Freiheit et al. | 166/373 |
| 7,134,488 | B2 * | 11/2006 | Tudor et al. | 166/184 |
| 2002/0189814 | A1 * | 12/2002 | Freiheit et al. | 166/373 |
| 2003/0024706 | A1 | 2/2003 | Allamon | |
| 2003/0136563 | A1 | 7/2003 | Allamon et al. | |
| 2004/0000406 | A1 | 1/2004 | Allamon et al. | |
| 2004/0000407 | A1 * | 1/2004 | Hernandez et al. | 166/386 |
| 2004/0035578 | A1 * | 2/2004 | Ross et al. | 166/250.15 |
| 2004/0256113 | A1 * | 12/2004 | LoGiudice et al. | 166/381 |

* cited by examiner

SURGE REDUCTION BYPASS VALVE

CROSS-REFERENCE TO RELATED APPLICATIONS

This application claims benefit of U.S. Provisional Patent Application Ser. No. 60/588,463, filed Jul. 16, 2004, which application is herein incorporated by reference in its entirety.

BACKGROUND OF THE INVENTION

1. Field of the Invention

Embodiments of the present invention generally relate to running casing into a wellbore. More specifically, embodiments of the present invention relate to managing surge pressure while running casing into the wellbore.

2. Description of the Related Art

To obtain hydrocarbon fluid production from the earth, a wellbore is drilled from the surface of the earth using a drill string. The drill string is a tubular body having a drill bit attached to its lower end for making a hole in the earth. After the drill string has drilled the wellbore to a first depth, the drill string is removed from the wellbore.

Subsequent to removing the drill string from the wellbore, a first section or string of casing is inserted into the drilled-out wellbore. Setting the first casing in the wellbore involves flowing cement into the annulus between the outer diameter of the first casing and the wall of the wellbore, then allowing the cement to cure.

Next, a further portion of wellbore extending to a second depth is drilled below the first portion of wellbore using the drill string. The drill string is removed, and a second casing string or casing section is run into the wellbore through the first casing and into the further portion of the wellbore. The second casing is sometimes termed a "liner" when it is placed below casing already within the wellbore. The second casing has a smaller outer diameter than the inner diameter of the first casing to allow the second casing to run through the first casing. When an upper portion of the second casing reaches a lower portion of the first casing, the second casing is temporarily hung off of the first casing, usually by a hanger. Cement is then flowed into the annulus between the outer diameter of the second casing and the wellbore and allowed to cure to set the second casing within the wellbore. This process is repeated as desired to place casings within the wellbore to form a cased wellbore of the desired depth.

Once the casings of increasing depths are placed within the wellbore, it is often necessary or desirable to run wellbore tools into the casing. Furthermore, after setting the casings within the wellbore at the desired depth for hydrocarbon production, the hydrocarbon fluid may migrate through the inner diameter of the casing within the wellbore to the surface of the wellbore. To allow for the maximum area for fluid flow during hydrocarbon production as well as to permit maximum clearance for wellbore tools through the cased wellbore, it is desirable that the cased wellbore possess the largest inner diameter possible for its depth; therefore, each subsequently-run casing usually has only a slightly smaller outer diameter than the inner diameter of the previously-run casing to allow for maximum effective inner diameter over the depth of the casing within the wellbore.

Because of the small variance between the outer diameter of the subsequently-run casing and the inner diameter of the previously-run casing, little annular clearance between casings may exist during run-in of the casing. The small area of annular clearance between the casings causes a large amount of surge pressure to be imparted on the formation below the previously-run casing when the subsequently-run casing is lowered into the wellbore. Over-pressurizing the formation causes damage to the formation, jeopardizing production of hydrocarbons.

Additionally, when running casing into the wellbore, fluid located within the wellbore tends to flow up through the inner diameter of the casing being run into the wellbore. Because of the pressure exerted on the formation when running in a casing when little annular clearance between casings exists, the fluid may flow from downhole up through the casings to relieve the pressure within the wellbore. The upward flow velocity problem is exacerbated by the presence of the running string used to run each casing into the wellbore. The running string typically has a reduced inner diameter compared to the inner diameter of the casing previously disposed within the wellbore, which causes an increase in pressure within the running string as the fluid flows upward through the running string. Due to the increase in pressure experienced by the fluid flowing upward within the running string, the fluid velocity tends to increase when it flows from the less restricted inner diameter of the disposed casing to the reduced diameter of the running string. An uncontrolled flow of fluid from downhole causes fluid to flow onto the rig floor from downhole, making the rig floor slippery and a safety hazard.

To partially alleviate the surge problem, casings are often run into the wellbore at reduced speeds to decrease pressure on the fluid within the wellbore caused by running in the casing. Reducing the speed of running casings into the wellbore and cleaning up the rig floor increases the amount of time required to obtain a producing wellbore, thus increasing the cost of the wellbore.

A similar problem occurs when running casing into a wellbore formed in a delicate formation, regardless of whether a previous casing exists and regardless of whether the clearance between casings is small. Running casing into a delicate formation could easily result in damage to the formation due to high downhole pressure caused by running the casing into the wellbore.

To prevent the problems that occur due to small clearance in the annulus between casings and due to pressure on delicate formations, diverter tools have been developed to divert fluid into the wellbore annulus while running the casing into the wellbore. The diverter tool is typically a tubular body disposed within the running string which is attached above the running tool, the running tool being connected directly to the casing. One proposed diverter tool includes ports within its tubular body for circulating fluid therethrough while running the casing into the wellbore. The ports are open while the casing is run into the wellbore and can only be closed once; therefore, this diverter tool is a one-shot tool. Generally, the diverter tool utilizes a hydrostatic pressure within a chamber to a move a sleeve to close the ports when a predetermined tool depth is reached. However, the hydrostatic pressure changes due to changes in depth; therefore, this diverter tool may not operate correctly when the wellbore is not a vertical wellbore (e.g., a deviated, lateral, directional, or horizontal wellbore).

Furthermore, when running casing into the wellbore, fluid typically flows upward into the casing as it is run downhole. However, sometimes while running the casing into the wellbore, the casing reaches an obstruction which prevents the casing from running further into the wellbore. The obstruction is often easily removed by circulating fluid down through the casing and out into the wellbore to wash away the obstruction (which may be a portion of the formation). While the proposed diverter tool allows closure of the ports for possible circulation of fluid down through the casing to wash away an obstruction, the one-shot nature of the diverter tool does not allow fluid to flow out through the ports in the diverter tool again as the casing is further lowered into the wellbore subsequent to removal of the obstruction, again creating the problem of a surge of fluid upon further downward movement of the casing into the wellbore due to the absence of a functioning diverter tool. Because the ports of the one-shot diverter tool cannot again be opened while the diverter tool is in the wellbore during the casing running operation, the possibility of formation damage is greatly increased. Consequently, casing running speeds are typically greatly decreased to attempt to minimize formation damage and loss of expensive drilling fluids. If the ports of the diverter tool must be re-opened to further run the casing into the wellbore, the running string must be removed from the wellbore and then again run into the wellbore. Multiple run-ins of the casing and servicing of the diverter tool after its removal from the wellbore add time and thus cost to the formation of the wellbore.

Another proposed diverter tool is run into the wellbore with the casing with the ports in the open position. The diverter tool includes a sleeve therein which moves to close the ports. Extending inward from the sleeve is a restriction in the inner diameter of the diverter tool which is capable of retaining a ball. When it is desired to close the ports, the ball is run into the inner diameter of the diverter tool until it reaches the inner diameter restriction. The ball rests on the inner diameter restriction, and pressurized fluid is flowed into the diverter tool so that the sleeve is forced by the pressure above the ball downward to close the ports. Upon sufficient pressure above the ball, the ball is blown through the restriction so that fluid flow through the diverter tool is again allowed. This diverter tool is disadvantageous because the inner diameter of the diverter tool is restricted. It is often desirable to run tools through the inner diameter of the diverter tool at various points in the operation, and the size of the tools which clear the inner diameter of the diverter tool is limited by a restricted inner diameter portion. Additionally, the area of fluid flow through the diverter tool is decreased by the restriction. This proposed diverter tool is also a one-shot tool which only permits closing the ports once without removing the running string for servicing of the diverter tool causing the same problems encountered in the other proposed diverter tool mentioned above.

Thus, there is a need for a diverter tool having one or more ports which may be opened or closed multiple times without user intervention or action beyond typical casing running operations. There is a further need for a diverter tool which does not restrict the bore of the running string, provides a full-bore opening through the diverter tool, and does not require disposing an external device through the tool to open or close the ports. There is yet a further need for a diverter tool which may be deactivated by an event produced by procedures or tools commonly utilized when running casing into the wellbore.

SUMMARY OF THE INVENTION

In one aspect, embodiments of the present invention provide a diverter tool for reducing surge pressure when running casing into a wellbore, comprising a tubular body having a longitudinal bore therethrough and an upper end and a lower end, a first fluid flow path through the bore between the upper and lower ends, and a second fluid flow path from the bore from a location between the upper and lower ends to outside the tubular body, the second fluid flow path openable and closable, wherein the second fluid flow path is normally closed.

In another aspect, embodiments of the present invention include a method of running casing into a wellbore. The method includes providing a tubular string, the tubular string including the casing and a diverter tool, the diverter tool having a bore therethrough and a bypass, wherein the bypass is capable of automatically moving between an open position and a closed position. The method further includes lowering the tubular string into the wellbore and automatically moving the bypass to the open position to allow fluid therethrough. Further, the method includes substantially ceasing the lowering of the tubular string and automatically moving the bypass to the closed position to cease fluid flow therethrough In yet another aspect, embodiments of the present invention provide a diverter tool for reducing surge pressure when running casing into a wellbore comprising a tubular body having a longitudinal bore therethrough and first and second ends, and a bypass valve through the tubular body between the first and second ends, the bypass valve capable of fluid flow therethrough and automatically movable between open and closed positions multiple times while the diverter tool is running the casing into the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention provides a diverter tool having a bypass valve for reducing surge pressure while running casing into the wellbore. The bypass valve is capable of automatically opening and closing multiple times while the casing is run into the wellbore without user intervention or activation beyond typical casing running procedures. This automatic opening and closing of the bypass valve allows the casing to be run into the wellbore at an increased speed as compared to other diverter tools because the probability and magnitude of damage to the formation is decreased. The diverter tool operates without restricting the bore of the running string or the diverter, thereby allowing full access through the inner diameter of the diverter tool. Moreover, the diverter tool does not require dropping or pumping any device into the tool to function the bypass valve during run-in of the casing. Advantageously, the diverter tool of the present invention provides an apparatus and method for reducing pressure on the formation and decreasing surge potential of fluid within the formation which is operable during the ordinary course of a casing running operation without external devices, restricted bores, or the limitation of a one-shot tool.

Figure 1:
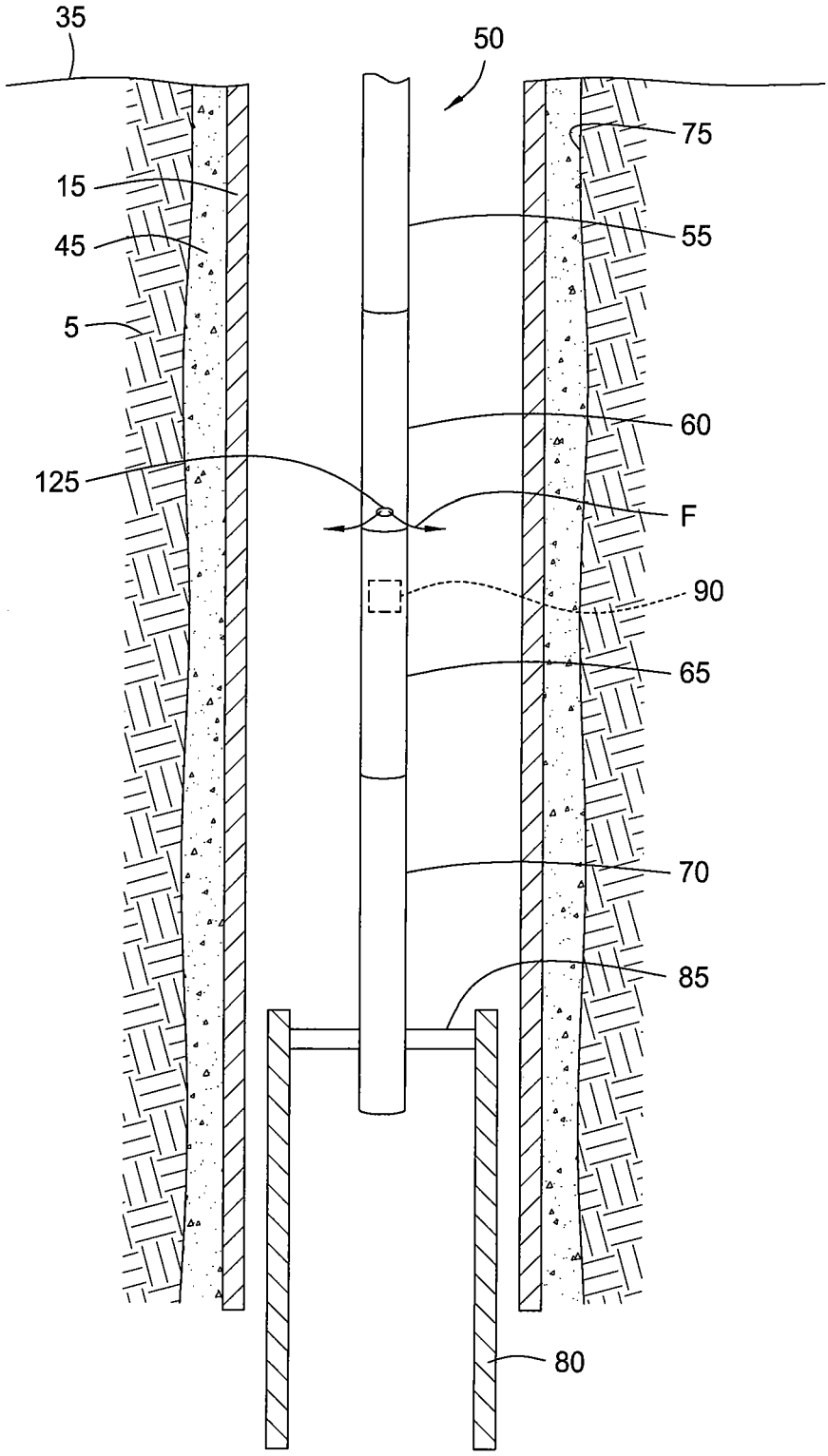
FIG. 1 is a cross-sectional view of casing attached to a running string having a diverter tool therein.

Shown in FIG. 1 is a running string 50 conveying casing 80 (the casing 80 may also be termed "liner") into a wellbore 75 formed in an earth formation 5. A portion of the wellbore 75 has casing 15 set therein by cement 45 or some other physically alterable bonding material within the annulus between the wall of the wellbore 75 and the outer diameter of the casing 15.

The running string 50 includes a running pipe 55, a diverter tool 60, a drill pipe 65, and a running tool 70. The running pipe 55 is used to lower the running string 50 from a surface 35 of the wellbore 75. A lower end of the running pipe 55 is connected to an upper end of the diverter tool 60, a lower end of the diverter tool 60 is connected to an upper end of the drill pipe 65, and an upper end of the running tool 70 is connected to a lower end of the drill pipe 65. In an alternate embodiment, the drill pipe 65 is not necessarily present between the diverter tool 60 and the running tool 70. In this instance, the lower end of the diverter tool 60 may be directly connected to the upper end of the running tool 70. The connections therebetween are preferably threadable connections, but may be any type of connections, direct or indirect, known by those skilled in the art. A substantially full bore runs through the length of the running string 50.

A lower portion of the running string 50 (specifically, the running tool 70) is releasably connected to an inner diameter of the casing 80 by a temporary attachment 85 such as a hanger. Fluid is flowable through the length of the bore of the running string 50 and through the casing 80.

FIGS. 2-5 show the diverter tool 60 in various positions, the operation of which is described below. The structural features of the diverter tool 60 are described in reference to all of FIGS. 2-5. Specifically, the diverter tool 60 has an upper end 102 and a lower end 104. The upper end 102 is connected, preferably threadedly connected, to the lower end of the running pipe 55, while the lower end 104 is connected, preferably threadedly connected, to the upper end of the drill pipe 65 (see FIG. 1). In the alternate embodiment where the drill pipe 65 is not included within the running string 50, the lower end 104 is connected to the upper end of the running tool 70.

The diverter tool 60 includes a body 105 having a longitudinal bore therethrough. The body 105 includes an upper body 110 at its upper end, a lower body 120 at its lower end, and a port body 115 disposed between the upper and lower bodies 110, 120. A lower end of the upper body 110 is connected to an upper end of the port body 115 by a threaded connection 112, while an upper end of the lower body 120 is connected to a lower end of the port body 115 by a threaded connection 107. The connections are threaded for illustrative purposes only, as it is contemplated that other types of connections between tubular bodies which are known by those skilled in the art may be employed in embodiments of the present invention. The bodies 110, 115, 120 may also be only operatively connected to one another rather than directly connected. Moreover, although the body 105, as shown, includes three connected body portions 110, 115, 120 other embodiments of the present invention include one continuous tubular body, two separate bodies connected to one another, or greater than three separate bodies connected to one another.

One or more sealing members 108 are disposed between the lower body 120 and port body 115 at the threaded connection 107, and one or more sealing members 111 are disposed between the upper body 110 and the port body 115 at the threaded connection 112. The sealing members 108, 111, which are preferably o-ring seals, provide a seal against fluid flow between the bore of the body 105 and the surrounding wellbore outside the body 105.

The upper end of the lower body 120 has a stop shoulder 127, which is a portion of the inner diameter of the lower body 120 which extends into the bore of the diverter tool 60 further than the connected portion of the port sleeve 170. The port body 115 also has an inwardly extending portion 126 which extends inward into the bore of the body 105 and includes an upper shoulder 129 and a lower shoulder 128.

Within the port body 115 are one or more sets of ports. The first set includes one or more bypass ports 125 which extend from the inner diameter of the port body 115 to the outer diameter of the port body 115 for allowing fluid flow therethrough from the bore of the diverter tool 60 to outside the diverter tool 60. In the embodiment shown, six bypass ports 125 are formed in the port body 115; however, any number of bypass ports 125 is contemplated in embodiments of the present invention. Also disposed through the port body 115 are one or more pressure ports 130 for communicating the pressure within the wellbore to a select portion of the diverter tool 60 (described in detail below). Shown in the embodiment of FIGS. 2-5 are four pressure ports 130 through the port body 115, but any number of pressure ports 130 may be located through the port body 115 in other embodiments of the present invention.

Figure 4:
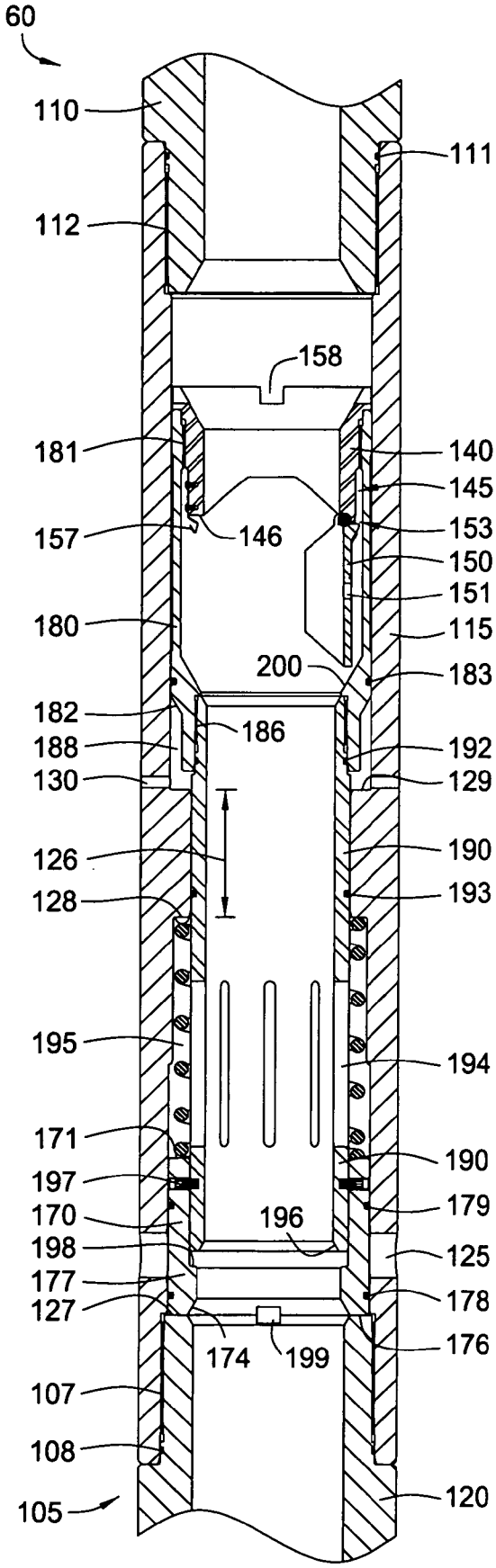
FIG. 4 is a section view of the diverter tool in the position for circulating fluid down through the casing.
Figure 5:
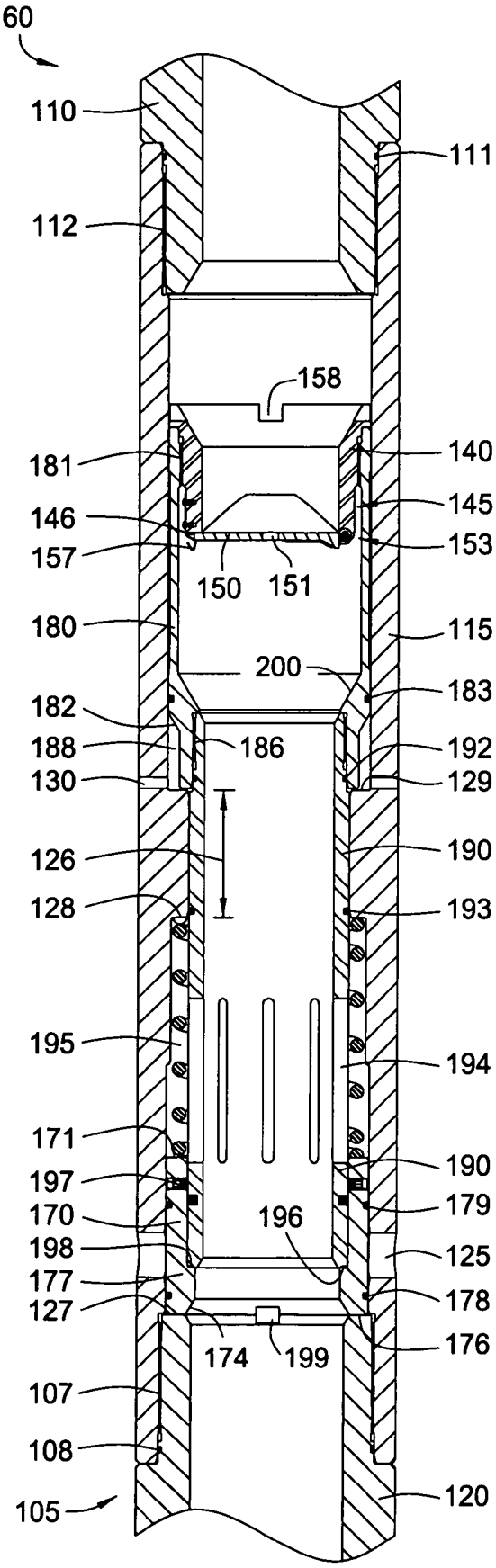
FIG. 5 is a section view of the diverter tool in the deactivated position.
Figure 7:
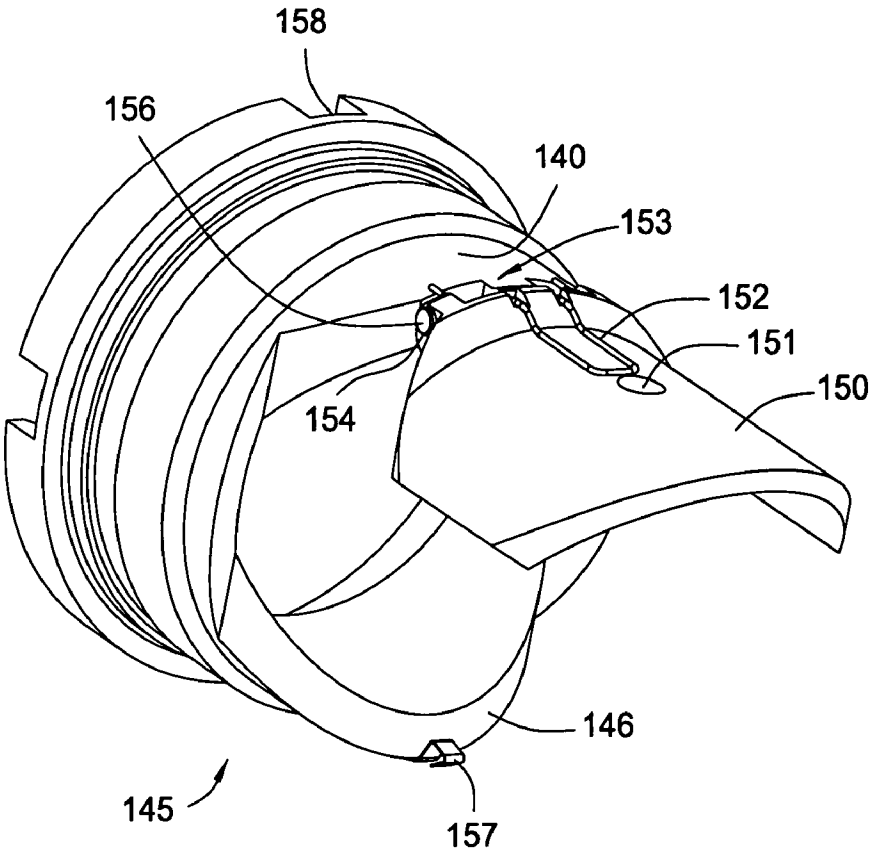
FIG. 7 is a perspective view of the flapper valve of FIG. 6 in the open position.
Figure 6:
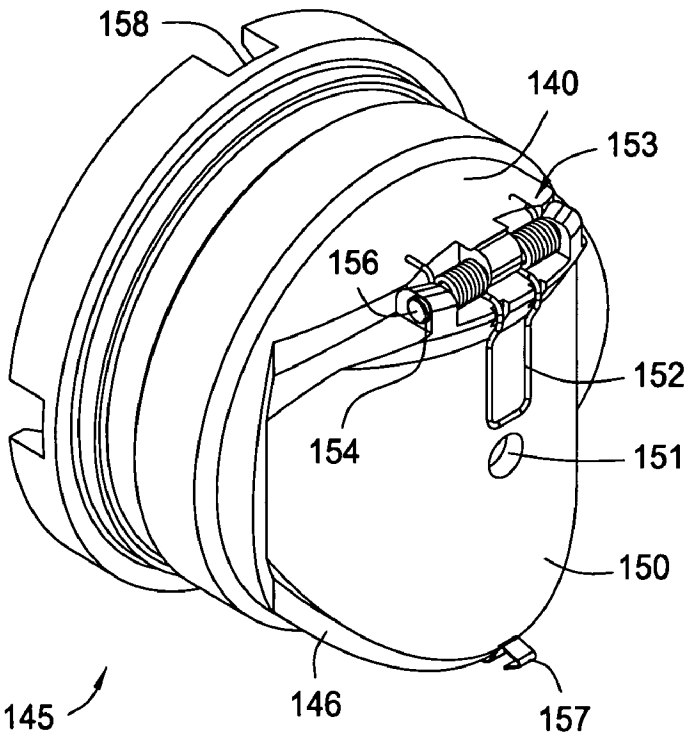
FIG. 6 is a perspective view of a curved flapper valve usable within the diverter tool. The flapper valve is in the closed position.

Located within the bore of the port body 115 is a flapper assembly 145 which is longitudinally slidable relative to the port body 115. The flapper assembly 145 is shown in FIGS. 2-5, but perspective views of the flapper assembly 145 shown in FIGS. 6 and 7 provide a more detailed view of the flapper assembly 145. Referring to FIGS. 6 and 7 primarily (but also to FIGS. 2-5), the flapper assembly 145 includes a flapper body 140 having a flapper seat 146 on which a flapper 150 rests when closed. The flapper 150 is preferably a curved flapper having one or more holes 151 extending therethrough to allow the upper portion of the bore of the diverter tool 60 disposed above the flapper 150 to fill with mud flowing up from the wellbore during run-in of the casing 80 (see description of the casing running operation below), thereby preventing collapse of the upper portion of the running string 50 due to lack of any fluid pressure in the upper portion. Therefore, the flapper 150 when closed substantially prevents fluid flow therethrough.

Figure 2:
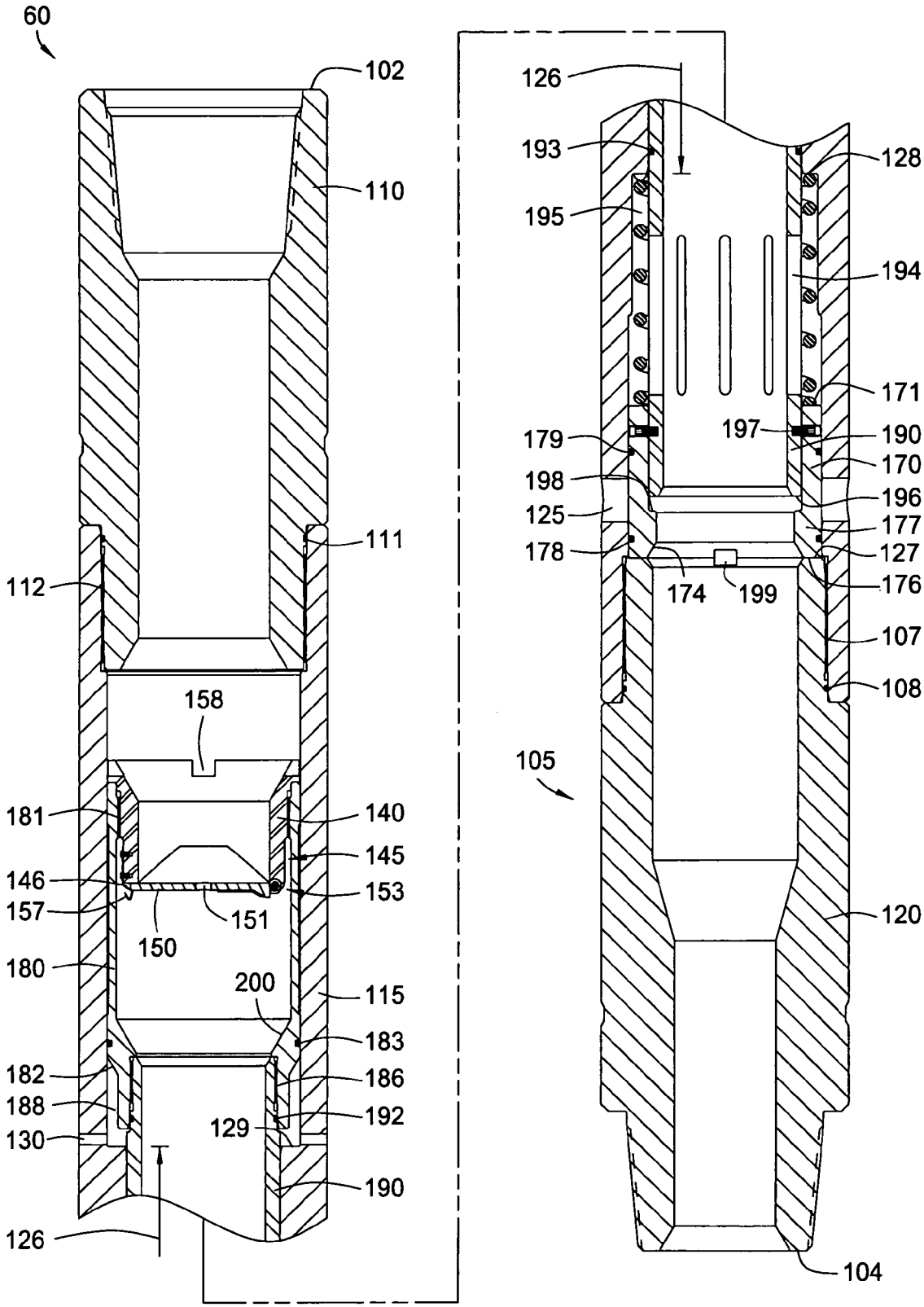
FIG. 2 is a section view of the diverter tool at the position prior to running the casing into the wellbore.
Figure 3:
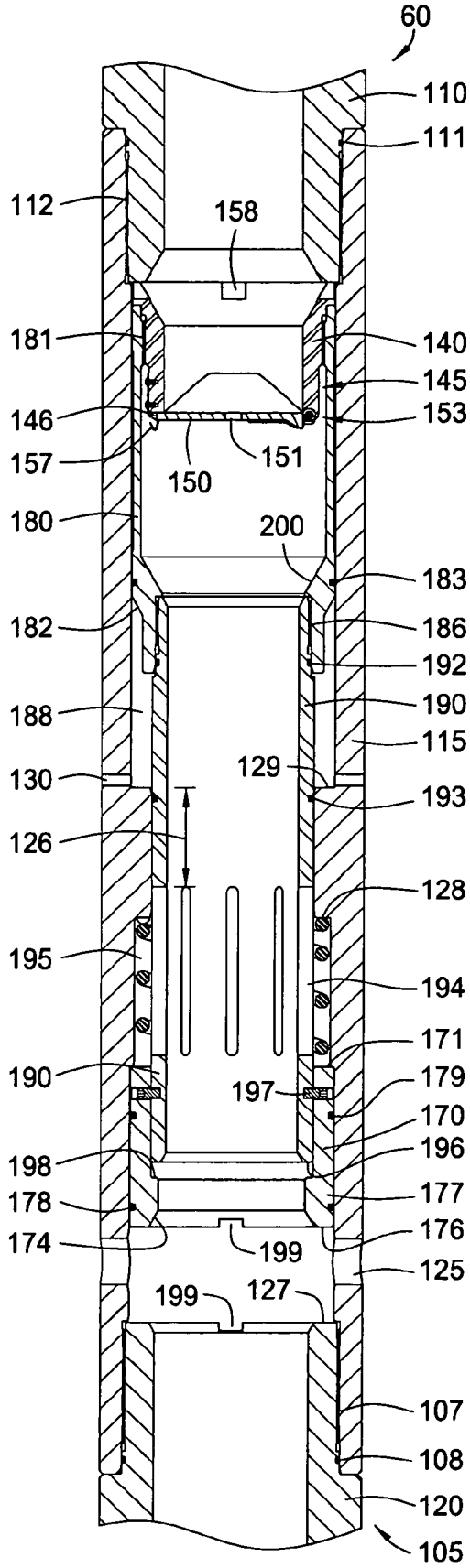
FIG. 3 is a section view of the diverter tool in position for running the casing into the wellbore.

The flapper 150 is biased in the closed position against the flapper seat 146 (FIGS. 2-3 and 6 show the flapper 150 in the closed position) and is downward facing with respect to the upper and lower ends 102, 104. A flapper hinge 153 disposed on the portion of the flapper body 140 substantially opposite from the flapper seat 146 hingedly connects the flapper 150 to the flapper body 140. Referring to FIGS. 6-7, the flapper hinge 153 includes a hinge pin 156 extending through a hinge hole 154 at an end of the flapper body 140. A torsionally resilient member 152, preferably a double torsion spring, causes the flapper 150 to bias towards rotation around the hinge 153 into the inner diameter of the body 105 until the flapper 150 reaches an obstruction, namely the flapper seat 146. The flapper 150 substantially prevents fluid flow through a portion of the bore of the body 105 and is preferably substantially perpendicular to the body 105 in the closed position. To open the flapper 150 to a position substantially parallel to the body 105 (see FIGS. 4 and 7), a force must push the flapper 150 downward so that the flapper 150 pivots around the hinge 153 in a direction away from the flapper seat 146.

As is most easily shown in FIG. 7, the flapper 150 is curved to a shape substantially similar to the contour of the flapper body 140 when the flapper 150 is in the open position. As will be described in more detail below, the flapper 150, when in the open position, fits against the bore of the diverter tool 60 and is curved sufficiently so that the bore through the diverter tool 60 is at least substantially unobstructed, whereby minimal to no restriction of the inner diameter of the diverter tool 60 exists due to the flapper 150. Because the opened flapper 150 does not obstruct the inner diameter of the diverter tool 60, the size of tools which may be run into the bore of the diverter tool 60 and the fluid flow path through the bore of the diverter tool 60 are not restricted.

The flapper assembly 145 shown in FIGS. 6-7 is self-aligning. The end of the flapper 150 which mates with the flapper seat 146 in the closed position (see FIG. 6) is curved to provide a substantial seal against fluid flow therethrough when closed, while the end of the flapper 150 which mates with the opposite portion of the flapper body 140 on which the flapper hinge 153 is located is substantially v-shaped (see FIG. 7). The portion of the flapper body 140 having the hinge 153 connected thereto has a corresponding v-shape to the v-shaped portion of the flapper 150. The mating v-shapes provide the self-aligning feature, so that the flapper 150 aligns with the curved surface of the flapper seat 146 to provide the seal against fluids, even if the flapper 150 initially is pushed off-center without any user manipulation. This self-aligning feature of the flapper assembly 145 results because the v-shaped surface of the flapper 150 is forced to mate with the opposing v-shaped surface of the adjacent flapper body 140 portion when the resilient member 152 forces the flapper 150 to close by rotating around the flapper hinge 153. Therefore, if the flapper 150 is inadvertently moved to a side of center, the flapper 150 still ultimately centers on the curved surface by centering on the flapper hinge 153.

One or more wrenching slots 158 may be located on an upper end of the flapper body 140 and spaced from one another. The wrenching slots 158 are provided to aid in assembly of the flapper assembly 145 in the diverter tool 60. As shown specifically in FIGS. 6 and 7, the flapper assembly 145 optionally includes a spring retaining clip 157 connected to the flapper seat 146, the function of which is described below.

Referring again to FIGS. 2-5, the flapper assembly 145 is connected to a surrounding flapper housing sleeve 180 by a threaded connection 181. As mentioned above in relation to threaded connections 107 and 112, it is also within the scope of embodiments of the present invention that the flapper assembly 145 may be connected to the flapper housing sleeve 180 by any other known connection means in lieu of the threaded connection. The flapper housing sleeve 180 is a tubular body with a longitudinal bore therethrough which is concentric with the port body 115 and the flapper assembly 145 and resides between the port body 115 and the flapper assembly 145 at its upper portion. The flapper housing sleeve 180 then extends below the flapper assembly 145, but remains substantially adjacent to the port body 115 for the rest of its length.

A lower portion of the inner diameter of the flapper housing sleeve 180 angles inward into the bore of the diverter tool 60 to form a sloped upper surface 200. Slightly below the sloped upper surface 200 on the outer diameter of the flapper housing sleeve 180 is a sloped lower surface 182 which slopes inward at an angle toward the bore of the diverter tool 60. Below the sloped lower surface 182, the flapper housing sleeve 180 continues downward within the diverter tool 60 at a smaller outer diameter from the sloped lower surface 182 than the outer diameter of the flapper housing sleeve 180 above the sloped lower surface 182 so that an annular area 188 exists between the outer diameter of the flapper housing sleeve 180 and the inner diameter of the port body 115.

Within the flapper housing sleeve 180 and concentric with the flapper housing sleeve 180 is a shear sleeve 190 having a longitudinal bore therethrough. The flapper housing sleeve 180 and the shear sleeve 190 are connected by a threaded connection 186 or any other connection method known by those skilled in the art. The shear sleeve 190 has a lower shoulder 196 at its lower end.

One or more sealing members 183 are disposed between the outer diameter of the flapper housing sleeve 180 and the inner diameter of the port body 115, one or more sealing members 192 are located between the outer diameter of the shear sleeve 190 and the inner diameter of the flapper housing sleeve 180, and one or more sealing members 193 are located between the outer diameter of the shear sleeve 190 and the inner diameter of the port body 115 at or near the inwardly-extending portion 126 of the port body 115. The sealing members 183, 192, 193 isolate the bore of the diverter tool 60 from the annulus between the diverter tool 60 and the wellbore (or surrounding casing) around the outside of the diverter tool 60 by only allowing the pressure outside of the diverter tool 60 to infiltrate through the pressure ports 130, into the annular area 188 within the port body 115 and outside the shear sleeve 190 and the flapper housing sleeve 180, and into the areas between the sleeves 180 and 190 and the port body 115 before the sealing members 183, 192, 193 are reached. The function of the pressure ports 130 and the differential pressure between the bore of the diverter tool 60 and the outside of the diverter tool 60 is delineated below in the description of the operation of the diverter tool 60 during a casing running operation.

Below the inwardly-extending portion 126 of the port body 115 and located between the outer diameter of the shear sleeve 190 and the inner diameter of the port body 115 (which is of a larger inner diameter at this portion) is a resilient member 195. The resilient member 195 is preferably a spring. The resilient member 195 extends from the lower shoulder 128 of the port body 115 inwardly-extending portion 126 to an upper shoulder 171 of a port sleeve 170 (described below). The resilient member 195 urges the port sleeve 170 against the stop shoulder 127 of the lower body 120 so that the port sleeve 170 covers the bypass ports 125 of the port body 115, as shown in FIGS. 2 and 4-5, until the bias force of the resilient member 195 is overcome by a pressure.

The port sleeve 170 is disposed between the inner diameter of the port body 115 and the outer diameter of the shear sleeve 190 and is shearably connected to the shear sleeve 190 by one or more frangible members 197, which preferably include one or more shear screws. The frangible members 197 extend from the inner diameter of the shear sleeve 190 through a portion of the shear sleeve 190 and from the outer diameter of the port sleeve 170 through a portion of the port sleeve 170 and are shearable upon application of a predetermined force thereto.

At a lower end of the port sleeve 170 is a lower shoulder 176 which is movable towards the stop shoulder 127 of the lower body 120 until stopped by the stop shoulder 127 and also movable away from the stop shoulder 127 (see description of the operation below). The port sleeve 170 also includes an inwardly-extending portion 177 which extends into the bore of the diverter tool 60 and has a smaller inner diameter than the other portions of the port sleeve 170. The inwardly-extending portion 177 provides a stop shoulder 198 which halts downward movement of the lower shoulder 196 of the shear sleeve 190 when the frangible members 197 are sheared and the shear sleeve 190 slides relative to the port sleeve 170. Furthermore, the inwardly-extending portion 177 forms a sloped portion 174 when it angles at a lower end from the larger inner diameter to the smaller inner diameter at the lower shoulder 176.

One or more sealing members 178 and 179 are disposed between the inner diameter of the port body 115 and the outer diameter of the port sleeve 170 above and below the bypass ports 125. The sealing members 178 and 179 act to isolate the inner diameter of the diverter tool 60 from the outside of the diverter tool 60 and prevent fluid from flowing out of the bore of the diverter tool 60 through the bypass ports 125 when the port sleeve 170 covers the bypass ports 125, as shown in FIGS. 2 and 4-5 (in this position, the bypass valve is closed). In addition to their function to seal between the bore of the diverter tool 60 and the outside of the diverter tool 60, the sealing members 179 cooperate with sealing members 193 to provide a sealed housing space for the resilient member 195 defined by the outer diameter of the shear sleeve 190, the upper shoulder 171 of the port sleeve 170 and the portions of the port sleeve 170 extending to the sealing members 179, and the inner diameter and lower shoulder 128 of the port body 115.

One or more slots 194 extending through the shear sleeve 190 are spaced about its circumference. The slots 194 provide a vent for the pressure from the housing space for the resilient member 195. Additionally, the slots 194 prevent impedance of movement of the resilient member 195 which may result from debris entering the coils of the resilient member 195 by allowing access to the resilient member 195 to clean out debris (e.g., mud). Additionally, one or more slots 199 are located at mating ends of the port sleeve 170 and the lower body 120 for assembling the diverter tool 60. When rotatably aligned, a rectangular-shaped key or tool may be inserted into the formed pocket to prevent rotation while the flapper assembly 145 is being threaded into the diverter tool 60 using the wrench slots 158.

In operation, the diverter tool 60 is assembled and connected to the running string 50, preferably as shown in FIG. 1. The running tool 70 is then connected by the temporary attachment 85 to the inner diameter of the casing 80 (or liner) to be run into the wellbore 75. FIG. 2 shows the diverter tool 60 in the resting position at least substantially absent fluid flow therethrough. In this initial position, the bypass ports 125 are closed off by the port sleeve 170 (biased over the bypass ports 125 by the resilient member 195), and the flapper 150 is biased closed by the resilient member 152.

The casing 80 is next lowered into the wellbore 75 using the running string 50. FIG. 3 shows the diverter tool 60 during ordinary running of the casing 80 into the wellbore 75. Lowering the casing 80 into the wellbore 75 with the diverter tool 60 in the position shown in FIG. 2 causes the connected port sleeve 170, the shear sleeve 190, the flapper housing sleeve 180, and the flapper assembly 145 to slide in conjunction with one another upward relative to the body 105 from the position shown in FIG. 2 to the position shown in FIG. 3. As the casing 80 is lowered into the wellbore 75 by the running string 50, fluid from within the wellbore 75 flows upward into the casing 80 through the running tool 70, drill pipe 65, and up through the diverter tool 60 (see FIG. 1). When the fluid reaches the closed flapper 150 within the diverter tool 60, because the flapper 150 is stopped from further rotational movement upward by the flapper seat 146 fluid pressure builds up within the bore of the diverter tool 60 below the flapper 150. As mentioned above, some fluid may flow through the hole 151 in the flapper 150 to prevent collapse of the running string 50 above the flapper 150 due to lack of opposing pressure to the pressure outside of the diverter tool 60; however, a net pressure below the flapper 150 ensues because of the differential pressure between above and below the flapper 150.

At a predetermined pressure buildup within the bore below the flapper 150, the fluid pressure below the flapper 150 overcomes the bias force of the resilient member 195 by pushing against the flapper assembly 145 to force the flapper assembly 145, flapper housing sleeve 180, shear sleeve 190, and port sleeve 170 upward relative to the body 105. Preferably, the bias force of the resilient member 195 is overcome at a pressure differential of approximately 20-80 psi. Even more preferably, the bias force of the resilient member 195 is overcome at a pressure differential of approximately 45 psi. A small pressure differential is preferred so as not to damage the surrounding formation 5. Shifting the flapper assembly 145, flapper housing sleeve 180, shear sleeve 190, and port sleeve 170 upward relative to the body 105, a predetermined distance uncovers the bypass ports 125 so that the port sleeve 170 no longer blocks fluid flow through the bypass ports 125. FIG. 3 shows the bypass ports 125 opened and the diverter tool 60 in position to circulate fluid through the bypass ports 125.

Opening the bypass ports 125 allows pressurized fluid flowing upward from within the wellbore 75 below to exit through the bypass ports 125 rather than surging upward through the running string 50 onto the rig floor. Furthermore, opening the bypass ports 125 relieves pressure from within the wellbore 75, preventing damage to the formation.

If at any point during the running of the casing 80 into the wellbore 75 an obstruction to running the casing 80 further into the wellbore 75 is reached which makes it desirable to circulate fluid from the surface 35 through the running string 50 to wash out the obstruction, the diverter tool 60 is automatically moved to the position shown in FIG. 4 by at least substantially ceasing fluid flow from the wellbore 75 into the diverter tool 60, which causes the bias force of the resilient member 195 to close the bypass ports 125. Fluid flow into the diverter tool 60 may be stopped by at least substantially halting downward movement of the diverter tool 60 (and thus the casing 80). Fluid may then optionally be introduced from the surface 35 downward through the running string 50 to perform a circulating operation. After it is determined that the obstruction is sufficiently removed and fluid introduction through the casing 80 from the surface 35 is halted, the diverter tool 60 automatically returns to the run-in position shown in FIG. 3 when fluid flow from the wellbore up through the casing 80 and running string 50 is resumed, preferably by lowering the casing 80 further into the wellbore 75. Thus, the bypass ports 125 always remain closed unless fluid is flowing upward through the diverter tool 60 and/or the resultant force from differential pressure acting on the flapper 150 exceeds the force of the resilient member 195 acting to close the port sleeve 170.

Whether or not the diverter tool 60 is moved to its circulating position shown in FIG. 4 during run-in of the casing 80, after running the casing 80 to its desired setting depth within the wellbore 75, fluid may be introduced from the surface 35 through the running string 50 to circulate around the outer diameter of the casing 80 to remove any debris previously removed from the formation 5 or debris from any other source to the surface 35. Regardless of the reason for circulating fluid, pressurized fluid is circulated down through the running string 50, down through the casing 80, out a lower end of the casing 80, up through the annulus between the outer diameter of the casing 80 and the wellbore 75 wall, up through the annulus between the outer diameter of the casing 80 and the inner diameter of the casing 15, and up through the annulus between the outer diameter of the running string 50 and the inner diameter of the casing 15 to the surface 35.

The diverter tool 60 is moved to the circulating position shown in FIG. 4 when fluid flow through the running string 50 from the wellbore 75 is halted. When circulating fluid down through the running string 50, pressurized fluid flowing downward overcomes the bias force of the resilient member 152 of the flapper 150, thus rotating the flapper 150 around the flapper hinge 153 into a position whereby the flapper is substantially flush with and substantially parallel to the flapper housing sleeve 180. (Although some fluid which flows downward through the bore of the diverter tool 60 escapes through the hole 151 to relieve some of the fluid pressure, the hole 151 is small enough in size to allow pressure buildup above the flapper 150 to cause the flapper 150 to open.) When the flapper 150 is in the open position as shown in FIG. 4, the bore of the diverter tool 60 is not restricted by the flapper 150 due to the curved design of the flapper 150 and is not restricted by any other tools necessary to operate the flapper 150. This feature of the diverter tool 60 is advantageous because if tools such as darts, plugs, or balls need to be pumped through the bore of the diverter tool 60 (e.g., in a cementing operation), the tools are not obstructed from flow through the bore by a restricted inner diameter. Although the curved design of the flapper 150 is used in embodiments described herein, it is contemplated that any shape or design of flapper or other one-way valve may be used in embodiments of the present invention.

When the flapper 150 is opened due to fluid flow downward through the diverter tool 60 bore, fluid may be circulated downward through the casing 80 because the bypass valve is closed when the port sleeve 170 covers the bypass ports 125 due to the bias force of the resilient member 195. No tools or profiles within the bore of the diverter tool 60 are necessary to close the bypass ports 125, as merely halting fluid flow through the diverter tool 60 from the wellbore 75 causes the bypass ports 125 to close to allow circulation through the length of the bore of the diverter tool 60 and thus through the casing 80 therebelow and into the wellbore 75 to the surface 35. The bypass ports 125 are biased closed to allow circulation at any time.

As briefly discussed above, the spring retaining clip 157 is an optional component on the flapper valve assembly 145 that may be utilized to provide a surge force to force the flapper assembly 145 and its connected port sleeve 170, shear sleeve 190, and flapper housing sleeve 180 downward over the bypass ports 125 if debris (e.g., cuttings from the formation or mud) is caught in one or more of the bypass ports 125. The spring retaining clip 157 aids in clearing debris from the bypass ports 125.

The cyclic function of the opening and closing of the bypass ports 125 is automatic without the need to vary from ordinary casing running and fluid circulating operations. Because the diverter tool 60 is naturally biased toward a closed bypass ports 125 position, it is not necessary to restrict the inner diameter of the diverter tool 60 by providing a ball or dart seat therein, drop a device into the wellbore 75, pump a device into the diverter tool 60, manipulate the diverter tool 60, or reach a certain depth within the wellbore 75 to cycle the diverter tool 60 closed. The naturally closed state of the diverter tool 60 without any manipulation makes the diverter tool 60 especially desirable from a wellbore control perspective.

An additional advantage of the diverter tool 60 is that cycling the diverter tool 60 closed is not a permanent action which ceases the flow of fluid through the bypass ports 125, but rather running the casing 80 further into the wellbore 75 again begins the flow of fluid from the wellbore 75 up through the bore of the diverter tool 60 and re-opens the bypass ports 125, allowing further running of the casing 80 into the wellbore 75 while reducing surge pressure. Thus, the diverter tool 60 avoids the problematic one-shot nature of currently used diverter tools.

If desired, the cyclic function of the diverter tool 60 (the opening and closing of the bypass ports 125) may be deactivated by the occurrence of a pressure increase within the running string 50. The pressure increase may be caused by the function of other downhole tools, many of which are utilized in an ordinary casing running or casing setting operation. Deactivation of the diverter tool 60 does not require additional time-consuming (and thereby costly) actions.

FIG. 5 shows the diverter tool 60 in the deactivated position wherein the cyclic opening and closing function of the bypass ports 125 is disabled. The cyclic function is disabled generally by uncoupling the flapper assembly 145 from the port sleeve 170. Specifically, a pressure event inside the diverter tool 60 which causes a pressure differential between the pressure within the diverter tool 60 and the pressure outside the diverter tool 60 shears the frangible member 197 so that the port sleeve 170 is uncoupled from the threadedly connected shear sleeve 190, flapper housing sleeve 180, and flapper assembly 145. When the port sleeve 170 is no longer attached to the flapper assembly 145 so that the flapper assembly 145 is slidable relative to the port sleeve 170, the bias force of the resilient member 195 is unopposed, so that the biasing force of the resilient member 195 permanently causes the port sleeve 170 to cover the bypass ports 125 and close this fluid path out from the diverter tool 60. In the disabled state of the diverter tool 60, fluid traveling up from the wellbore 75 into the diverter tool 60 would build up pressure below the flapper 150, but only move the flapper assembly 145 and the attached flapper housing sleeve 180 and shear sleeve 190 upward. By the same token, in the disabled state of the diverter tool 60, fluid introduced from the surface 35 into the diverter tool 60 would cause the flapper assembly 145, flapper housing sleeve 180, and shear sleeve 190 to slide downward within the diverter tool 60, but would not affect the closed-off state of the bypass ports 125.

The pressure differential which causes the diverter tool 60 to become disabled exists between the annular area 188 and the inside of the diverter tool 60. The pressure within the wellbore 75 is communicated into the annular area 188 by the pressure ports 130. The wellbore pressure acts upward on the lower end of the flapper housing sleeve 180 as well as the sloped lower surface 182 of the flapper housing sleeve 180, while the pressure within the bore of the diverter tool 60 acts downward on the sloped upper surface 200 of the flapper housing sleeve 180. When a pressure event occurs inside the bore of the diverter tool 60, the pressure within the bore which acts downward on the sloped upper surface 200 becomes greater than the pressure outside the diverter tool 60 which acts upward on the lower end and the sloped lower surface 182 of the flapper housing sleeve 180. At this point, the port sleeve 170 is biased downward over the bypass ports 125 by the resilient member 195. At a predetermined pressure differential between the bore pressure and the wellbore pressure, the frangible member 197 is sheared so that the diverter tool 60 is in the deactivated position shown in FIG. 5. In the deactivated position, the bypass ports 125 remain closed independent of fluid flow from the wellbore 75 through the diverter tool 60.

Numerous pressure events may be used to cause the diverter tool 60 to deactivate. Although not an exhaustive list of pressure events which may be utilized, several pressure events which are already ordinarily performed in the course of a casing running operation allow a sufficient increase of pressure within the diverter tool 60 to deactivate the diverter tool 60. Casing 80 is ordinarily set within the wellbore by a physically alterable bonding material such as cement, in a cementing operation. The cementing operation typically involves running one or more cement plugs (or darts) into the casing 80 to separate the cement from other wellbore fluids. To release the plugs or darts from the casing 80 to circulate the plugs or darts downhole, pressure must be increased above the cement plugs or darts to force the cement plugs or darts out from their position within the casing 80. Pressuring up during the cementing operation could cause a sufficient pressure differential between the inside of the diverter tool 60 and the outside of the diverter tool 60 to deactivate the diverter tool 60. Other pressure events typically encountered during a casing running operation which may be utilized to deactivate the diverter tool 60 include increasing the pressure within the diverter tool 60 to activate a gripping assembly such as one or more slips (e.g., a hydraulic liner hanger) to hang the casing 80 being run into the wellbore 75 off of the casing 15 previously set within the wellbore 75 (see FIG. 1) or off of the open hole wellbore 75, increasing the pressure within the diverter tool 60 to release subsea plugs, and increasing the pressure within the diverter tool 60 to shear the float valve or check valve bypass tubing (the float valve or the check valve may be used to prevent u-tubing of the cement through the casing 80 as well as facilitate curing of the cement by only allowing downward flow of fluid through the casing 80 and not upward flow of fluid above the float or check valve) from the inner diameter of the casing 80. Float equipment such as a float valve or check valve may be released, activated, converted, or engaged by the pressure event. The pressure event may be caused by the functional operation of any tool or mechanism located within the bore of the running string or casing, located below the bypass valve, which involves an increase in pressure within the bore of the diverter tool 60. Exemplary tools which may be utilized to cause the pressure event include, but are not limited to, a plug indicator, float collar, float shoe, subsea running tool, ball seat, landing seat, landing collar, or any restriction within the bore of the diverter tool 60.

In some embodiments of the present invention shown in FIGS. 1-7, one or more sensors 90 may be included within or near the diverter tool 60 to sense fluid flow or other fluid parameters. The one or more sensors may be included within a separate housing from the diverter tool 60, within a housing attached to the diverter tool 60, or without a surrounding housing. The information obtained by the sensors 90 may then be transmitted to the surface 35 of the wellbore 75 to a surface monitoring and control unit for processing of the information. The sensors 90 may be utilized to activate or deactivate the operation of the diverter tool 60.

Although the embodiments described above employ a flapper valve within the diverter tool 60, embodiments of the present invention are not limited to a diverter tool with a flapper valve. Other embodiments may include any other type of one-way valve known to those skilled in the art, including a ball valve or check valve. Similarly, embodiments of the present invention may include other valve types known to those skilled in the art in lieu of the bypass valve in the diverter tool 60. Additionally, instead of the flapper valve, the diverter tool 60 could include a rubber diaphragm.

In the above description, the "upper," "lower," "upward," "downward," and other relative terms are merely used herein to provide a reference for actions performed and relative locations of portions of the apparatus. Therefore, other directional movements and relative locations are contemplated for use in embodiments of the present invention, such as in a horizontal, lateral, or directionally-drilled wellbore.

The above description primarily relates to embodiments of the present invention used in cased wellbores. However, it is contemplated that in other embodiments of the present invention, the wellbore may be open hole and uncased, for example in deep sea applications. In deep sea applications, the diverter tool 60 may be utilized to divert wellbore fluids into a sub-sea riser pipe which extends between the sea floor and the drilling rig at the surface of the body of water.

While the foregoing is directed to embodiments of the present invention, other and further embodiments of the invention may be devised without departing from the basic scope thereof, and the scope thereof is determined by the claims that follow.

The invention claimed is:

1. A diverter tool for reducing surge pressure when running casing into a wellbore, comprising:
   - a tubular body having a longitudinal bore therethrough and first and second ends;
   - a first fluid flow path through the bore between the first and second ends, wherein the first fluid flow path is openable and closable by a valve assembly located within the bore;
   - a second fluid flow path from the bore through a location between the ends to outside the tubular body, the second fluid flow path automatically openable and closable by a blocking mechanism moveable over a port disposed between the ends of the tubular body, wherein the blocking mechanism is coupled to the valve assembly and wherein the second fluid flow path is biased closed; and
   - an uncoupling member configured to release the blocking mechanism from the valve assembly upon a condition in the diverter tool, thereby closing the second fluid flow path.

2. The diverter tool of claim 1, wherein the second fluid flow path is automatically openable by fluid within the bore flowing from the first end to the second end.

3. The diverter tool of claim 2, wherein fluid flows within the bore from the first end to the second end while running the casing into the wellbore.

4. The diverter tool of claim 2, wherein the second fluid flow path is automatically closable in the absence of at least substantial fluid flow within the bore.

5. The diverter tool of claim 2, wherein the second fluid flow path is automatically closable when the casing is substantially stationary relative to the wellbore.

6. The diverter tool of claim 1, wherein the second fluid flow path is automatically openable and closable during a casing running operation.

7. The diverter tool of claim 1, wherein opening and closing the second fluid flow path is repeatable while the diverter tool is disposed within the well bore.

8. The diverter tool of claim 1, wherein the blocking mechanism is moveable by fluid flowing through the bore.

9. The diverter tool of claim 8, wherein the blocking mechanism is a sliding sleeve.

10. The diverter tool of claim 1, wherein the valve assembly is a flapper valve assembly.

11. The diverter tool of claim 10, wherein a curvature of the flapper is substantially the same as a curvature of the bore of the diverter tool.

12. The diverter tool of claim 1, wherein the second fluid flow path is permanently closable.

13. The diverter tool of claim 1, wherein the condition is a predetermined pressure differential between the bore and the outside of the tubular body.

14. A method of running casing into a wellbore, comprising:

providing a tubular string, the tubular string including the casing and a diverter tool, the diverter tool having a bore therethrough, a bypass assembly, and a valve member, wherein the bypass assembly is capable of automatically moving between an open position and a closed position;

closing the valve member thereby at least partially obstructing the bore;

lowering the tubular string into the wellbore and automatically moving the bypass assembly to the open position to allow fluid therethrough while allowing a portion of fluid to flow past the closed valve member through the bore of the diverter tool; and automatically moving the bypass assembly to the closed position to cease fluid flow therethrough.

15. The method of claim 14, further comprising flowing the fluid through the bypass assembly into an annular area defined between the tubular string and the wellbore thereabout.

16. The method of claim 14, further comprising cycling the bypass assembly between the open position by lowering the tubular string at a predetermined rate and the closed position by decreasing the lowering to a rate below the predetermined rate.

17. The method of claim 16, wherein the bypass assembly is opened by fluid flow through the diverter tool in a first direction, and the bore is closed by fluid flow through the diverter tool in a second direction.

18. The method of claim 14, further comprising introducing fluid into the tubular string from a surface of the wellbore when the bypass assembly is in the closed position.

19. The method of claim 14, further comprising creating a pressure differential between an interior portion of the diverter tool and an area outside of the diverter tool to disable the bypass assembly.

20. The method of claim 19, wherein the valve member is a flapper valve capable of at least substantially closing fluid flow through the bore.

21. The method of claim 14, wherein the bypass assembly comprises a sliding sleeve which moves towards and away from one or more ports to open and close the bypass assembly.

22. The method of claim 21, wherein the sliding sleeve is biased by a biasing member to close the bypass assembly.

23. The method of claim 14, wherein the fluid flow path through the bore is substantially closed during lowering the tubular string into the wellbore.

24. A diverter tool for reducing surge pressure when running casing into a wellbore, comprising:

a tubular body having a longitudinal bore therethrough and a first end and a second end;

a bypass valve through the tubular body between the first and second ends, the bypass valve capable of fluid flow therethrough and automatically movable between open and closed positions multiple times during the operation of running the casing into the wellbore; and a bore obstructing member configured to substantially obstruct the flow of fluid from the second end to the first end in a closed position and allow the flow of fluid from the first end to the second end in an open position.

25. The diverter tool of claim 24, wherein automatic operation of the diverter tool is achievable without manipulating the tubular body separate from running the casing into the wellbore.

26. The diverter tool of claim 24, wherein one or more sensors are located proximate to the diverter tool to activate the bypass valve.

27. The diverter tool of claim 24, wherein the bore obstructing member in the closed position is configured to allow a portion of fluid to flow past the bore obstructing member and through the bore when running casing into the wellbore.

28. The diverter tool of claim 27, wherein the bore obstructing member comprises a hole formed therein.

29. A diverter apparatus for use in a pipe string to be lowered in a wellbore, the diverter apparatus comprising:

a tubular housing defining a longitudinal central flow passage, the tubular housing having at least one flow port defined therethrough intersecting the longitudinal central flow passage;

an assembly comprising a first portion attached to a second portion such that the assembly automatically alternates the diverter apparatus between an open position, wherein fluid is communicated between the central flow passage and an annulus defined between the tubular housing and a side of the wellbore through the at least one flow port, and a closed position wherein communication through the at least one flow port is blocked; and an uncoupling member configured to uncouple the first portion and the second portion, thereby disabling the assembly.

30. The diverter apparatus of claim 29, wherein the first portion is a bore obstructing member and the second portion is a bypass valve.

31. The diverter apparatus of claim 29, wherein the uncoupling member is activated when a pressure differential is established between an inside portion of the diverter tool and an area outside of the diverter tool caused by an increase in pressure within the diverter.

32. A method of running casing into a wellbore, comprising:

providing a tubular string, the tubular string including the casing and a diverter tool, the diverter tool having a bore therethrough, a bore flow restrictor that senses fluid flow through the bore and a bypass comprising a bypass valve member that opens and closes the bypass, wherein the bypass is capable of automatically moving between an open position and a closed position and wherein the bypass valve member and the bore flow restrictor are releasably coupled such that the bore flow restrictor causes movement of the bypass valve member between the closed and open positions;

lowering the tubular string into the wellbore and automatically moving the bypass to the open position to allow fluid therethrough; and automatically moving the bypass to the closed position to cease fluid flow therethrough, wherein a pressure differential between an inside portion of the diverter tool and an area outside of the diverter tool caused by an increase in pressure within the diverter tool uncouples the bore flow restrictor and the bypass valve member, thereby disabling the bypass.

* * * * *